US006302260B1

(12) United States Patent
Hänsch

(10) Patent No.: US 6,302,260 B1
(45) Date of Patent: Oct. 16, 2001

(54) APPARATUS FOR CORRECTING THE POSITION OF FLAT OBJECTS CONVEYED IN AN OVERLAPPING STREAM

(75) Inventor: Egon Hänsch, Wetzikon (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/584,289

(22) Filed: May 31, 2000

(30) Foreign Application Priority Data

Jun. 1, 1999 (CH) ..... 1028/99

(51) Int. Cl.[7] ..... B65G 47/26

(52) U.S. Cl. ..... 198/418.8; 198/461.2; 271/264; 271/198

(58) Field of Search ..... 198/460.3, 418.8, 198/418.9, 462.1, 461.2, 462.2; 271/264, 198, 314, 216, 182

(56) References Cited

U.S. PATENT DOCUMENTS

| | | | | |
|---|---|---|---|---|
| 3,834,288 | * | 9/1974 | Behrens et al. | 93/93 R |
| 4,007,824 | * | 2/1977 | Reist | 198/462 |
| 5,100,124 | * | 3/1992 | Pouliquen | 198/418.9 |
| 5,394,974 | * | 3/1995 | Reist | 198/418.9 |
| 5,722,655 | * | 3/1998 | Reist | 271/270 |

FOREIGN PATENT DOCUMENTS

| | | | |
|---|---|---|---|
| 677778 A5 | | 6/1991 | (CH) . |
| WO99/35072 A1 | | 7/1999 | (WO) . |
| PCT/CH98/00561 | * | 7/1999 | (WO) ..... 198/418.8 |

* cited by examiner

*Primary Examiner*—Robert J. Oberleitner
*Assistant Examiner*—Devon Kramer
(74) *Attorney, Agent, or Firm*—Alston & Bird LLP

(57) ABSTRACT

The apparatus has a first conveyor 10 and a second conveyor 16 mounted immediately downstream thereof. Arranged above the first conveyor 10 is a position changing device 50, whose displacement elements 68 are intended to strike the trailing edge 22' of fed objects 22 and to feed them to the second conveyor at the correct phase angle. Arranged at the end of the first conveyor 10 is a restraining device 34, whose restraining element 46 projects into the movement path of the leading edges 22' of the objects 22 and in each case is briefly withdrawn from this restraining position into a release position outside the movement path of the leading edges 22' when a displacement element 68 is moving an object 22 past it into the delivery nip 30. The restraining device 34 prevents too many objects arriving being fed to the second conveyor 16 out of synchronism.

11 Claims, 2 Drawing Sheets

70''
70
70'
48''
50
68
22''
68'
22
$V_3$
$< A_1$
22'
20
30
S
10
F,$V_1$
46
$V_2$
16
38
34
18
32

APPARATUS FOR CORRECTING THE POSITION OF FLAT OBJECTS CONVEYED IN AN OVERLAPPING STREAM

BACKGROUND OF THE INVENTION

The present invention relates to an apparatus for correcting the position of flat objects, in particular printed products, arriving overlapped on a conveyor.

An apparatus of this type is disclosed by CH-A-677 778. A position changing device is arranged in the downstream end region of a first conveyor, between conveyor tapes forming the conveying plane. It has two disks which are arranged beside each other in the conveying plane and driven in opposite directions, on which a displacement cam is situated eccentrically in each case. These displacement cams are intended in each case to come into contact with the trailing edge of each object arriving on the first conveyor in an overlapping stream and to accelerate said object in the conveying direction and feed it to the second conveyor. The latter is assigned a braking device which is intended to brake the objects accelerated by the rotation of the discs to the conveying speed of the second conveyor. By coordinating the circumferential speed of the displacement cams to the conveying speed of the first conveyor and the distance between the printed products in the overlapping formation fed, it is possible to achieve the situation in which the distance between the printed products is made uniform, and the printed products can be conveyed away at a phase angle predefined by the further processing means. Connected upstream of the position changing device is a restraining device constructed as a circulating driven pressing band, in order at least to secure the following printed product, in contact with the printed product accelerated by the displacement cams, against being carried along as well. In addition to the risk of damaging the printed products because of the high speeds, accelerations and retardations associated with this apparatus, in particular at a high processing capacity, there is the risk that if there is a very small distance between the trailing edges of successive printed products, the restraining device is ineffective and the printed product following the printed product on which influence has been exerted will be carried along out of synchronism.

An apparatus which can be employed more universally and with careful handling of the objects is disclosed in the earlier international patent application No. PCT/CH98/00561. It has a displacement element which is moved along a movement path by means of a drive, a working section of the movement path extending at least approximately rectilinearly and at least approximately in the conveying direction of the flat objects, such as printed products. In the working section, the displacement element is driven without retardation at a speed which, at the downstream end of the working section, as the objects are transferred to a second conveyor, is at least approximately equal to the conveying speed of this second conveyor. The frequency with which the displacement element is moved through the working section in the conveying direction F is approximately 1.2 to 1.4 times as high as the quotient of the first conveying speed, at which the objects are fed to the working section, and a permissible minimum distance between the trailing edges of successive objects in the overlapping formation arriving. If the distance between the trailing edges of successive objects in the overlapping formation arriving falls below the permissible minimum distance, there is the risk that the next object, following an object too closely, will be carried along and conveyed onward in an uncorrected manner because of the frictional forces.

It is an object of the present invention to develop the apparatus of the generic type in such a way that the security against inadvertently carrying objects along when correcting the position of objects is increased.

SUMMARY OF THE INVENTION

The above and other objects and advantages of the invention are achieved by the provision of an apparatus for correcting the position of flat objects as they are conveyed in an overlapping stream, and which comprises a first conveyor and a second conveyor mounted immediately downstream of the first conveyor. A position changing device mounts a plurality of displacement elements which move along a movement path so as to feed the objects on the first conveyor one after the other to the second conveyor by striking a trailing edge of the objects.

A restraining device has, downstream of the displacement element, a restraining element which projects into the movement path of the leading edge of the objects and is moved out of this position outside the region of the movement path of the leading edges only when an object may move past in the correct position. The restraining element forms, so to speak, a lock which in each case permits an object to pass through only at precisely defined times. An object which is not in the correct position is held back until the restraining element releases it in correct phase. As a result of the interaction between the restraining element and the displacement element, both as a result of action on the leading edge and/or trailing edge, it is ensured that in each case only a single object is fed to the second conveyor, and this in correct phase. In addition, in this way the objects are kept in a controlled mutual position during displacement. It is not possible for an adjacent object to be influenced by frictional forces.

BRIEF DESCRIPTION OF THE DRAWINGS

The invention will be described in more detail using two exemplary embodiments which are illustrated in the drawings, in which, in purely schematic form.

DETAILED DESCRIPTION OF THE PREFERRED EMBODIMENTS

Figure 1:
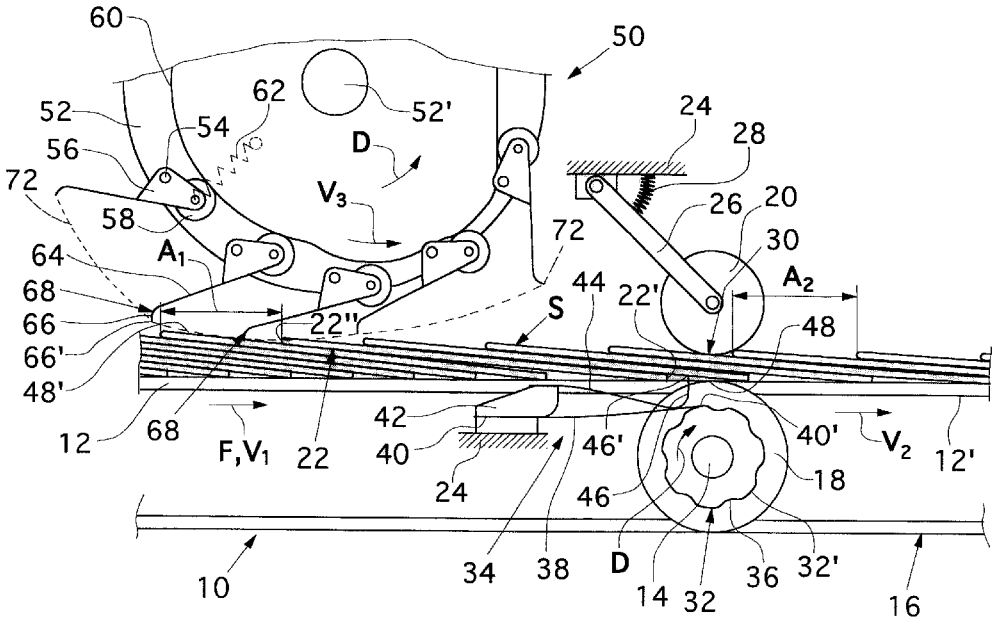
FIG. 1 ws an elevation of a first embodiment of the apparatus according to the invention.

The apparatus shown in FIG. 1 has a first conveyor 10 which is constructed as a tape conveyor whose conveyor tapes 12 are driven continuously in the conveying direction F at a speed $v_1$. At the downstream end of the first conveyor 10, the conveyor tapes 12, as generally known, are led around coaxially mounted deflection wheels. The shaft on which these deflection wheels are mounted is designated by 14. Between the aforementioned deflection wheels there are situated further deflection wheels 18—of which only one is visible in FIG. 1—of the same diameter, which are keyed onto the shaft 14 and around which the further conveying tapes 12' of a second conveyor 16 connected immediately downstream of the first conveyor 10 are led. The second conveyor 16 is likewise driven in the conveying direction F, but now at a conveying speed $v_2$ which is higher than the conveying speed $v_1$ of the first conveyor.

Freely rotably mounted above deflection wheels 18 assigned to the second conveyor 16 are pressure rollers 20 which, together with the conveyor tapes 12' led around these relevant deflection wheels 18, form a delivery nip for the flat objects 22, in the present case folded printed products, such as newspapers, periodicals and the like. The pressure rollers 20 are arranged at the free end of a bearing lever 26 which is pivotably mounted on a machine frame 24 and which is held prestressed in the direction of the shaft 14 by means of a compression spring 28 acting between said lever and the machine frame 24. The conveyor tapes 12' and pressure rollers 20 form a delivery nip 30 for the objects 22, which are fed to the second conveyor 16 in correct position and phase.

Also keyed onto the shaft 14 is a cam wheel 32 of a restraining device 34. The cam wheel 32 has sections 32' distributed uniformly in the circumferential direction and running concentrically with the shaft 14, and indentations 36 between said sections 32'. In addition, the restraining device 34 has a spring element 38 designed as a leaf spring, whose longitudinal direction runs approximately in the conveying direction and which is held clamped on the machine frame 24, by its upstream end section 40, such that it rests with its opposite end 40' on that side of the cam wheel 32 which faces the pressure rollers 20 and thus the movement path of the objects 22, with prestress on said cam wheel 32. The end section 40 is clamped between the machine frame 24 and a carrying element 42, to which there is fastened a leaf spring 44 which, with a curve formed by a bent section, rests on the spring element 38 close to the free end 40' of the latter, and whose bent-over end section forms a restraining element 46 of the restraining device 34. The restraining element 46, running approximately at right angles to the conveying direction F, is held in a restraining position, projecting into the movement path of the leading edges 22' of the objects 22, via the spring element 38, by means of the cam wheel 32 and via the conveyor tapes 12, when the end 40' is resting on one of the sections 32'. As soon as this section 32' runs off the end 40', this end 40' passes into an indentation 36, as a result of which the restraining element 46 is briefly moved back downward out of the movement path of the leading edge 22' of the objects 22 and into a release position. As a result, an object 22 resting with its leading edge 22', if need be, on the restraining element 46 is released and conveyed into the delivery nip 30. During the subsequent lifting of the restraining element 46, the latter comes into contact with its free end 46' on the underneath flat side 48 of this object fed to the second conveyor 16 and, as said object is conveyed onward, remains in contact until the next time it is moved out of the movement path of the leading edges 22' of the objects 22. The objects 22 are conveyed in an overlapping formation, in which each object rests on the respectively following one. The spring element 38 ensures that the end 46' rests on the flat side of the relevant object 22, even if the distance of the latter from the conveying tape 12 increases—because of the following object 22 located underneath. Care has to be taken that the restraining element 46 should be located upstream of the delivery nip 30, but preferably as close as possible to the delivery nip 30.

Upstream of the restraining device 34—as viewed in the conveying direction F—and above the first conveyor 10, there is arranged a position changing device 50 for the objects 22 fed in overlapping formation S. The position changing device 50 has a carrying wheel 52 which is driven continuously about its axis 52' running at right angles to the conveying direction F, on which wheel bearing elements 56 after the style of a two-armed lever are mounted distributed uniformly in the circumferential direction along a circle about the axis 52' and about stub axles 54 parallel to the wheel axis. At the leading end, as viewed in the direction of rotation D, of each bearing element 56, a control roller 58 is freely rotably mounted on the latter, said control rollers interacting with a control cam 60 which runs around the axis 52' and is arranged to be fixed. By means of a tension spring 62, indicated only schematically, the control rollers 58 are pulled inward in the radial direction and thus in the direction toward the control cam 60. In addition, on each bearing element 56 there is fastened a leaf spring element 64, which is curved outward in the radial direction at its free end and which, on the side away from the control roller 58, projects like a cantilever beyond the bearing element 56. The bent-over end region 66 of the leaf spring element 64 forms a displacement element 68, which is intended in each case to feed an object 22, fed by means of the first conveyor 10, to the restraining element 46, by striking the trailing edge 22" of said object 22, and then to feed it to the delivery nip 30 and onward to the second conveyor 16.

The direction of rotation D and the continuous rotational speed of the carrying wheel 52 are selected such that the displacement elements 68, in a working section 70 of their circulation path 72, move in the conveying direction F at a speed $V_3$ which is higher than the conveying speed $v_1$ and lower than or equal to the conveying speed $v_2$ of the second conveyor 16.

The control cam 60 is shaped in such a way that the displacement element 68, that is to say the leaf spring element 64, at the upstream end 70" of the working section 70, rests with its free end 66' on the top free flat side 48' of an object 22 and, in sliding contact with the latter, is moved as far as the downstream end 70' of the working section 70. A contribution to this is also made, on the one hand, by the spring characteristic of the leaf spring element 64 and, on the other hand, by the spring 62. In the working section 70, the control cam 60 is constructed in such a way that in the case of the thinnest overlapping formation S to be processed, the control roller 58 rests on said formation, and the leaf spring element 64 rests under prestress on the flat side 48'. In the case of a thicker overlapping formation, it is conceivable that the control roller 58 will lift off the control cam 60, counter to the force of the tension spring 62. At the downstream end 70', the bearing elements 56 are pivoted by means of the control cam 60 in the direction counter to the direction of rotation D in such a way that the displacement element 68 lifts off from the objects 22.

As measured in the conveying direction F, the downstream end 70' of the working section 70 is located at a distance from the delivery nip 30 which approximately corresponds to the length, measured in the conveying direction, of the objects 22 arranged in the overlapping formation S. The distance between the end 70' of the working section 70 and the restraining element 46 is only slightly less than the aforementioned distance.

The preferred frequency with which the displacement elements 68 are moved in the conveying direction F through the at least approximately rectilinear working section 70 is approximately 1.2 to 1.4 times as high as the quotient of the first conveying speed $v_1$, at which the objects 22 are fed, and a permissible minimum distance $A_1$ between the trailing edges 22" of successive objects in the overlapping formation S arriving. In addition, it is preferable for the conveying speed $v_2$ of the second conveyor to be at least approximately 2 to 4 times as high as the first conveying speed $v_1$. The quotient of the second conveying speed $v_2$ and the desired distance $A_2$, at which the objects 22 are conveyed onward, is far greater than the quotient of the first conveying speed $v_1$ and the minimum distance $A_1$ in the formation arriving.

In addition, it is preferable for the working section 70 of the movement path 72 to be at least approximately twice as long as the permissible minimum distance $A_1$ between the trailing edges 22" of successive objects 22 in the formation arriving, as is disclosed in the earlier CH patent application 1997 2986/97 and the corresponding international patent application PCT/CH98/00561.

The apparatus according to the invention with the restraining device 34 ensures that all the objects 22 fed are conveyed onward in the correct position and correct phase even if the distance between individual objects 22 in the overlapping formation fed falls below the permissible minimum distance $A_1$. This will be explained with reference to FIGS. 2 to 6. These show the apparatus shown in FIG. 1 at different times during an operating cycle; the same reference symbols as in FIG. 1 are used for identical parts.

Figures 2, 3, 4, 5, 6:
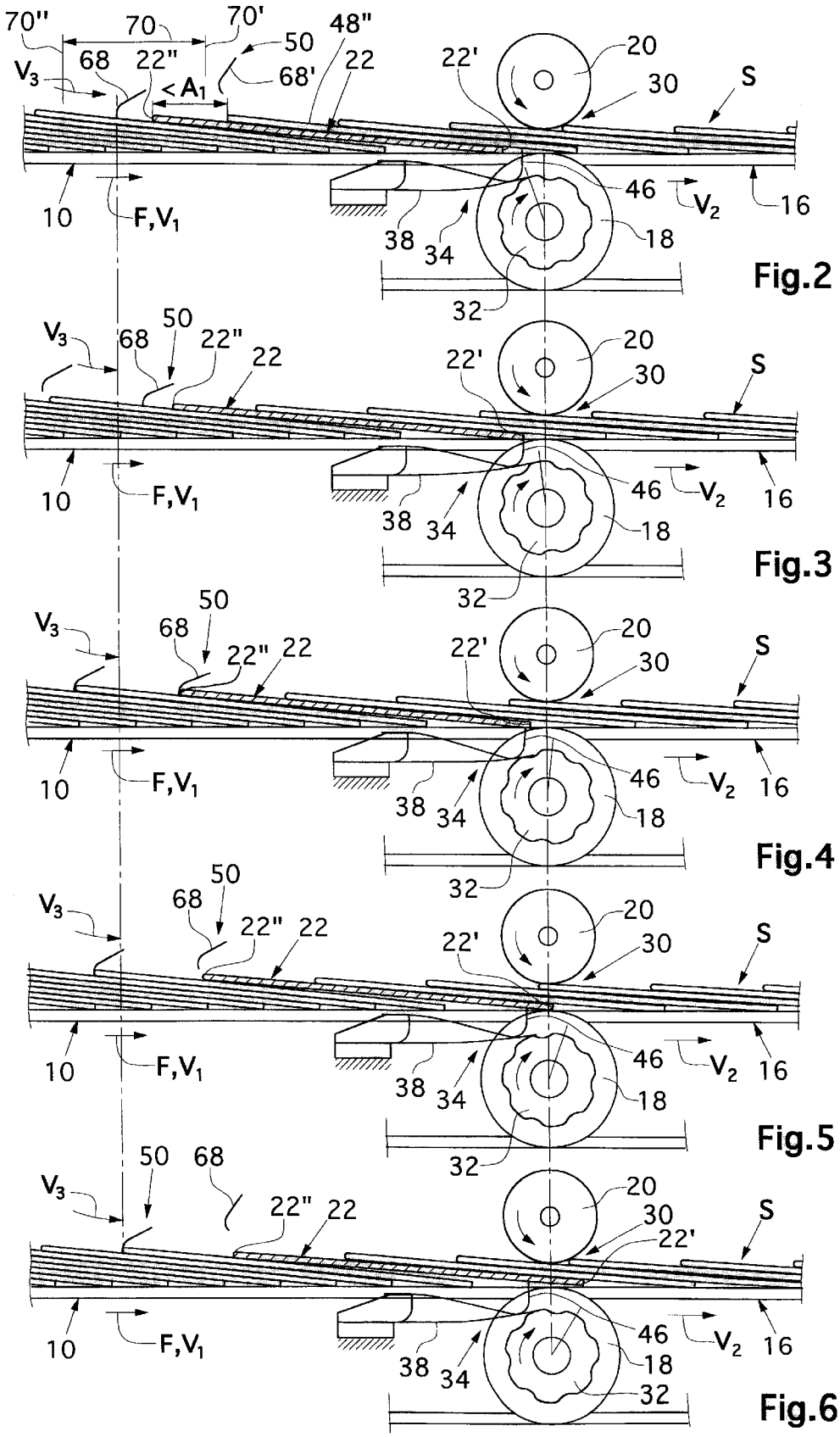
FIGS. 2 to 6 show the apparatus shown in FIG. 1 at different times during an operating cycle.

A displacement element, designated by 68' in FIG. 2, has just pushed an object 22 with the leading edge 22' at the front into the delivery nip 30, by striking its trailing edge 22", and is being removed from the top flat side 48" of the following object 22 by being pivoted in the clockwise direction. The restraining element 46 is resting in the restraining position on the bottom flat side 48 of that object which has been fed to the delivery nip 30. The displacement element 68 following the displacement element 68' has come into contact with the top flat side 48" of the next-but-one object 22 at the upstream end 70" of the working section 70. The object immediately preceding this object—shown hatched so that it can be seen better—has a distance from the trailing edge 22" of the object 22 fed to the delivery nip 30 which is shorter than the minimum distance $A_1$.

As FIG. 3 reveals, this object 22 now comes into contact with its leading edge 22' on the restraining element 46, which is located in the restraining position, as a result of which it is held back and prevented from being carried along in the conveying direction F.

As soon as the displacement element 68 has reached the trailing edge 22" of the held-back object 22, the restraining element 46 is moved back out of the movement path of the leading edge 22' into the release position, after which the displacement element 68 can convey the object 22 onward into the delivery nip 30 with the leading edge 22' at the front. This is shown by FIG. 4. It can also be seen in this figure that the restraining element 46 is moved back into the restraining position again immediately after an object 22 has been released.

As FIG. 5 shows, upon reaching the downstream end 70' of the working section 70, the displacement element 68 is removed from the object 22 fed into the delivery nip 30. A following displacement element 68 has reached the working section 70 in the meantime, and has come into contact with the trailing edge 22" of the following object 22. The latter is now conveyed toward the delivery nip 30 at the speed $V_3$ by the relevant displacement element 68—FIG. 6—the restraining element 46 being moved back into the release position, because of the synchronization between the position changing device 50 and the restraining device 34, when the relevant displacement element 68 is at a distance from the restraining element 46, measured in the conveying direction, equal to the length of the object 22. In this case, the leading edge 22' of the object 22 can be moved unimpeded past the restraining device 34 and fed to the delivery nip 30.

Figure 7:
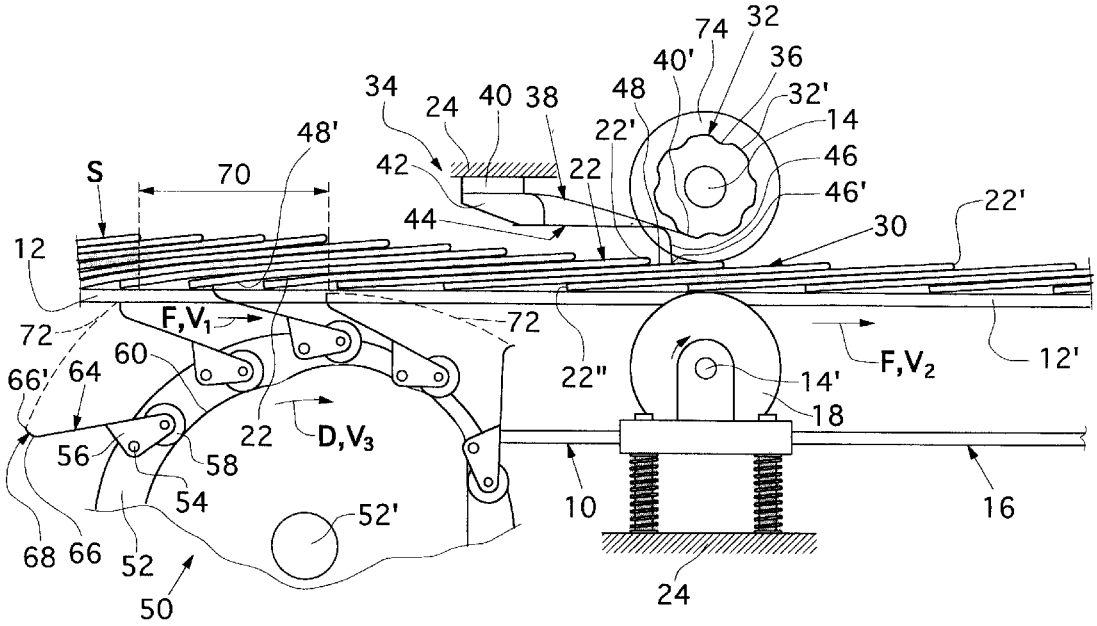
FIG. 7 likewise shows an elevation of a second embodiment of the apparatus according to the invention.

FIG. 7 shows an embodiment of the apparatus which is suitable for correcting the position, in correct phase, of objects 22 which are fed in an overlapping formation S' in which each object rests on the preceding one. The first conveyor 10 and the second conveyor 16 are constructed in the same way as in the case of the apparatus according to FIGS. 1 to 6, but now the shaft 14' on which the deflection wheels 18 for the conveyor tapes 12, 12' of the conveyors 10 and 16 are mounted, is suspended in a sprung manner and prestressed upward such that it can be forced back. These deflection wheels 18 now perform, so to speak, the function of the pressure rollers 20 of the embodiment according to FIG. 1, there now being seated on the shaft 14 for the cam wheel 32 reference wheels 74 which, as viewed in the vertical direction, define the position of the overlapping formation S and, together with the conveyor tapes 12' led around the deflection wheels 18, form the delivery nip 30. Otherwise, the restraining device 34 is constructed in mirror-image fashion to the restraining device 34 shown in FIG. 1 and described further above.

The position changing device 50 arranged underneath the first conveyor 10 and upstream of the restraining element 46 is constructed in mirror-image fashion to the position changing device 50 shown in FIG. 1 and described further above. The displacement elements 68 are moved through between adjacent conveyor tapes 12 of the first conveyor 10 into the working section 70 of their circulation path 72 and into the movement path of the trailing edges 22" of the objects 22.

The way in which the embodiment shown in FIG. 7 functions is the same as that embodiment shown in FIG. 1. If need be, the restraining element 46 holds back objects 22 which arrive at it too early by the top leading edge 22', and the displacement elements 68 are intended to feed the objects 22 to the delivery nip 30 and thus to the second conveyor 16 by striking their bottom trailing edge 22".

It should be mentioned that the objects 22 are fed to the second conveyor 16 always at the desired cycle rate. Since, however, the position changing device 50 and the restraining device 34 are driven at a processing speed which is approximately 20 to 40% higher than the highest regular arrival of the objects, from time to time, for one cycle or possibly two or more successive cycles, no object 22 will be fed to the second conveyor 16. However, the important fact that is all the objects fed to the second conveyor 16 are at the correct phase angle, and the distance between successive objects always corresponds to the required distance $A_2$ or an integer multiple thereof.

It is also conceivable to construct the restraining element 46 differently and to drive it in a different way, for example via a piston/cylinder unit.

Of course, the distance between the trailing edges 22" of the objects arriving can vary considerably. However, it should not be less than the minimum permissible distance $A_1$, or only for individual objects.

If the speed $v_2$ is higher than the speed $v_1$, the distance between the leading edges 22' or the trailing edges 22" of successive objects is increased.

That which is claimed:

1. An apparatus for correcting the position of flat objects as they are conveyed in an overlapping stream, and comprising a first conveyor which defines a conveying direction (F) and is driven at a conveying speed ($v_1$) and which is adapted to feed the objects in an overlapping arrangement, a second conveyor mounted immediately downstream of the first conveyor which is driven at a higher conveying speed ($v_2$) than the conveying speed ($v_1$) of the first conveyor, a position changing device mounting a plurality of displacement elements which move along a movement path and, at least in a working section of the movement path, are driven at a higher speed ($v_3$) than the conveying speed ($v_1$) of the first conveyor so as to feed the objects on the first conveyor one after another to the second conveyor by striking a trailing edge of each object, and a restraining device having a restraining element positioned downstream of the working section and moveable between a restraining position projecting into the movement path of the leading edges of the objects so as to act as a stop for the leading edge of the objects and a release position outside the movement path, and a drive element for moving the restraining element between said restraining and release positions in a manner coordinated with the movement of the displacement elements and so that in the restraining position the restraining element acts to hold back objects that arrive too early until the associated displacement elements have caught up with their trailing edges.

2. The apparatus as claimed in claim 1, wherein the restraining element is arranged at a distance from the downstream end of the working section which is at most approximately equal to the length of the objects measured in the conveying direction (F), and in each case is moved into the release position shortly before the displacement element reaches the downstream end of the working section.

3. The apparatus as claimed in claim 2, wherein between the restraining element and the drive element there is arranged a spring element positioned to keep the restraining element in the restraining position, in contact with a flat side of the objects respectively fed by the displacement element to the second conveyor.

4. The apparatus as claimed in claim 3 wherein the drive element comprises a cam wheel driven in synchronism with the displacement elements.

5. The apparatus as claimed in claim 4, wherein the spring element is designed like a leaf spring and is clamped on one side under pre-stress in the direction of the cam wheel and, at its free end, interacts with the cam wheel.

6. The apparatus as claimed in claim 5, wherein the restraining elements are each formed by the bent-over free end section of a leaf spring which is held at the other end and rests on the spring element.

7. The apparatus as claimed in claim 4 further comprising means defining a delivery nip which is arranged downstream of the restraining element and is driven in the conveying direction (F) and at the conveying speed ($v_2$) of the second conveyor, and to which the displacement elements feed the objects.

8. The apparatus as claimed in claim 7, wherein the delivery nip is bounded by the second conveyor.

9. The apparatus as claimed in claim 8 wherein the second conveyor includes a conveyor belt which leads around a deflection wheel which is arranged coaxially with the cam wheel.

10. The apparatus as claimed in claim 1 wherein the plurality of displacement elements are arranged on a continuously driven carrying wheel, and distributed uniformly in the circumferential direction along a circle about the wheel axis.

11. The apparatus as claimed in claim 10 wherein the displacement elements are mounted to the carrying wheel so as to be pivoted about axes parallel to the wheel axis and, in their pivoted position, are controlled by a pivoting cam running around the wheel axis in such a way that, at the upstream end of the working section, they come into contact with a flat side of the object following the object to be displaced, then slide along this flat side in the conveying direction (F) and, at the downstream end of the working section, are lifted off the flat side.

* * * * *